US008382010B2

(12) United States Patent
Nadler et al.

(10) Patent No.: US 8,382,010 B2
(45) Date of Patent: Feb. 26, 2013

(54) DOSING DEVICE WITH A MANUALLY ACTUATABLE PUMPING MEANS

(75) Inventors: Guenter Nadler, Moos-Iznang (DE); Juergen Greiner-Perth, Gottmadingen (DE)

(73) Assignee: Aptar Radolfzell GmbH, Radolfzell (DE)

( * ) Notice: Subject to any disclaimer, the term of this patent is extended or adjusted under 35 U.S.C. 154(b) by 651 days.

(21) Appl. No.: 12/224,124

(22) PCT Filed: Feb. 5, 2007

(86) PCT No.: PCT/EP2007/000945

§ 371 (c)(1),
(2), (4) Date: Aug. 18, 2008

(87) PCT Pub. No.: WO2007/096049

PCT Pub. Date: Aug. 30, 2007

(65) Prior Publication Data

US 2009/0026289 A1 Jan. 29, 2009

(30) Foreign Application Priority Data

Feb. 21, 2006 (DE) ..... 10 2006 008 874

(51) Int. Cl.
*B05B 7/32* (2006.01)

(52) U.S. Cl. ..... 239/329; 239/337; 239/331; 239/583; 222/321.1; 222/321.6; 222/321.7

(58) Field of Classification Search ..... 239/302, 239/337, 344, 353, 329, 331, 340, 583; 222/189.09, 222/321.1, 321.6, 321.9, 321.7, 321.8
See application file for complete search history.

(56) References Cited

U.S. PATENT DOCUMENTS

| | | | | |
|---|---|---|---|---|
| 3,391,647 | A * | 7/1968 | Cooprider et al. | 417/456 |
| 4,726,747 | A | 2/1988 | Skorka | |
| 5,899,363 | A | 5/1999 | Bliss, III et al. | |
| 6,059,151 | A | 5/2000 | Fuchs | |
| 7,066,359 | B2 | 6/2006 | Greiner-Perth | |
| 7,182,226 | B2 | 2/2007 | Mbonyumuhire | |
| 7,201,296 | B2 | 4/2007 | Graf | |
| 2002/0003151 | A1 * | 1/2002 | Beranger et al. | 222/321.7 |
| 2004/0000567 | A1 | 1/2004 | Greiner-Perth | |

(Continued)

FOREIGN PATENT DOCUMENTS

| | | |
|---|---|---|
| DE | 39 09 031 A1 | 9/1990 |
| DE | 601 04 119 T2 | 8/2005 |

(Continued)

OTHER PUBLICATIONS

Form PCT/ISA/210 International Search Report dated Sep. 10, 2007 (7 pages).

(Continued)

*Primary Examiner* — Jason Boeckmann
(74) *Attorney, Agent, or Firm* — Flynn, Thiel, Boutell & Tanis, P.C.

(57) ABSTRACT

A dosing device with a manually actuated pumping component, which includes a pumping chamber, an inlet valve and an outlet valve in the region of a dosing opening, is provided. An inlet region in the region of the inlet valve and/or an outlet region in the region of the outlet valve is/are provided with flow profiles. The dosing device is to be used for dispensing pharmaceutical liquids.

13 Claims, 5 Drawing Sheets

U.S. PATENT DOCUMENTS

| | | | |
|---|---|---|---|
| 2004/0256414 | A1 | 12/2004 | Graf |
| 2005/0098583 | A1 | 5/2005 | Mbonyumuhire |
| 2005/0135951 | A1 | 6/2005 | Garcia et al. |
| 2007/0131799 | A1 | 6/2007 | Le Maner et al. |

FOREIGN PATENT DOCUMENTS

| | | | |
|---|---|---|---|
| DE | 10 2005 009 296 | A1 | 2/2006 |
| EP | 0 901 835 | A2 | 3/1999 |
| EP | 1 295 646 | A1 | 3/2003 |
| JP | 2005-503263 | A | 2/2005 |
| WO | WO 2005/045292 | A1 | 5/2005 |

OTHER PUBLICATIONS

Form PCT/ISA/237 Written Opinion of International Searching Authority (7 pages).

Ottice Action in German Patent Office dated Nov. 20, 2006 (5 pages).

English translation of Office Action issued in JP Application No. 2008-555658 dated Oct. 11, 2011 (5 pages).

* cited by examiner

PG
13b
11b
16b
10b 6b
7b
15b
12b
4b
3b
8b
9b
B
1b
P

DOSING DEVICE WITH A MANUALLY ACTUATABLE PUMPING MEANS

FIELD OF THE INVENTION

The invention relates to a dosing device with a manually actuatable pumping means, which comprises a pumping chamber and an inlet valve constructed as a slide valve and which is movable by means of a dosing stroke in a sealing manner in a dosing channel in its closed position and which defines a dosing volume for the pumping chamber, the dosing channel opening on the inlet side into an inlet area.

BACKGROUND OF THE INVENTION

Such a dosing device is known from EP 12 95 646 A1. The known dosing device has a medium reservoir on which is placed a manually actuatable pumping means. The pumping means is provided with a pumping chamber, whose volume can be modified by a thrust piston. With the pumping chamber is associated an inlet valve and an outlet valve, the latter being held in a spring-loaded manner in the closed position. The inlet valve is in the form of a slide valve, which by means of a dosing stroke is held in a dosing channel in a sealing position and therefore in a closed position. Facing the medium reservoir, to the dosing channel and therefore the inlet valve is connected an inlet area, which widens in a stepped manner relative to the dosing channel. In its closed position the slide valve moves from above through the dosing channel until it passes over the stepped shoulder on moving into the inlet area and in this way opens the pumping chamber to the medium reservoir.

One object of the invention is to provide a dosing device of the aforementioned type, which permits an improved dosing operation.

This object is achieved in that the inlet area is provided with flow profilings. Thus, on opening the slide valve there is an improved flow characteristic for the medium flowing out of the medium reservoir from the dosing channel to the inlet area, so that there is an improved filling and consequently a more precise dosing for the dosing device. Unlike in the prior art where the transition between the dosing channel and the inlet area is formed by a circumferential annular step, the transition between inlet area and dosing channel as a result of the flow profilings of the inlet area is now such that there is an improved flow transfer. The flow pro-filings are preferably in the form of a profiled annular wall.

In a development of the invention the flow profilings are oriented in a longitudinal direction of the dosing stroke. Preferably a corresponding longitudinal profiling is formed by several longitudinal grooves, which extend in a uniformly distributed manner parallel to a pumping axis over the inlet area circumference. As a function of the medium introduced and desired inlet characteristic, said longitudinal grooves can be made wider or narrower. The depth of the longitudinal grooves preferably corresponds to the radius difference between the radius of the dosing device portion connecting to the inlet area towards the medium reservoir and the radius of the dosing channel.

In a further development of the invention the inlet area and dosing channel are provided on separate components, which is very advantageous from the manufacturing standpoint. As a result the dosing devices can be manufactured very precisely with relatively small dimensions. As a result of the bipartite nature, a particularly accurate opening characteristic for the slide valve can be obtained.

In a further development of the invention the components are joined together in coaxially interengaging manner and the components are so profiled on their facing circumferential surfaces that between the latter is formed at least one gas flow capillary tube between axially facing front edges of the circumferential surfaces. This ensures that a desired venting or ventilating can take place.

In a further development of the invention the at least one gas flow capillary tube is at one end open to the environment and at its other end into a medium reservoir, and on the end facing said medium reservoir is provided a filter unit. This makes it possible to ventilate the medium reservoir without bringing about a contamination of the medium by the ambient air.

The invention also relates to a dosing device for fluids having a manually actuatable pumping means, as well as with a dosing opening from which the fluid passes out of the dosing device, the dosing opening being connected by at least one fluid guide path to the pumping means and with the dosing opening is associated an outlet valve opening as a function of the pressure in the fluid guide path, the dosing opening having at least one axially sealing valve seat and in which the outlet valve comprises a sealing stem cooperating with the valve seat.

EP 12 95 646 A1 discloses a dosing device in which the outlet valve comprises a cylindrical sealing stem, which cooperates with a both axially and radially acting valve seat in the vicinity of a dosing opening of the dosing device.

A further object of the invention is to provide a dosing device of the aforementioned type, which has an improved spray characteristic.

This object is solved in that the valve seat has a shell portion radially enveloping the sealing stem, that an annulus is provided coaxially around the shell portion and that the sealing stem is surrounded by a labyrinth rim, which projects into the annulus in such a way that there are labyrinth-like flow guide paths to the dosing opening. Particularly in the case of a dosing opening constructed as a spray nozzle, this leads to advantages with respect to the spray characteristic, whilst a more precise dosing is also obtained. The invention solution is particularly suitable for liquid media used in the pharmaceutical or cosmetics sectors. The labyrinth rim is shaped integrally onto the outlet valve and coaxially and spacedly surrounds the sealing stem preferably oriented concentrically to a pumping axis of the pumping means.

In a development of the invention there is an outflow area with flow profilings upstream of the dosing opening in the outflow direction, which leads to an improved outflow characteristic in the vicinity of the dosing opening.

In a further development of the invention the sealing stem and shell portion are so mutually cylindrically constructed in a coaxially corresponding manner that additionally a radial sealing seat can be obtained, which leads to an improved opening and closing of the outlet valve.

In a further development of the invention the annulus is constructed as a circular annular groove and the labyrinth rim as a circular annular web, which has a smaller cross-section than the free cross-section of the annular groove. In a further development in the closed position of the outlet valve the adjacent surfaces of the labyrinth rim are spaced from one another. This ensures that also in the closed position of the outlet valve the labyrinth-like flow guide paths within the dosing device and therefore within the pumping chamber are completely filled with liquid medium. The fluid flow deflection directly upstream of the outlet from the dosing opening permits a particularly advantageous discharge characteristic and preferably an improved spray characteristic.

In a further development of the invention the labyrinth rim has an at least substantially rectangular cross-section. The labyrinth rim is preferably circumferentially circular. The term at least substantially rectangular cross-section more particularly means that the labyrinth rim is at least partly formed by substantially rectangular edges.

In a further development of the invention the annulus has an at least substantially rectangular cross-section. Preferably the contour of said cross-section is adapted to the outer contour of the labyrinth rim.

In a further development of the invention the outer circumference of the labyrinth rim is conically bevelled. In a further development the annulus has a conically tapered wall. Preferably the conical surfaces of the labyrinth rim and the annulus are oriented parallel to one another.

BRIEF DESCRIPTION OF THE DRAWINGS

Further advantages and features of the invention can be gathered from the claims and the following description of preferred embodiments of the invention relative to the attached drawings, in which:

DETAILED DESCRIPTION

Figure 1:
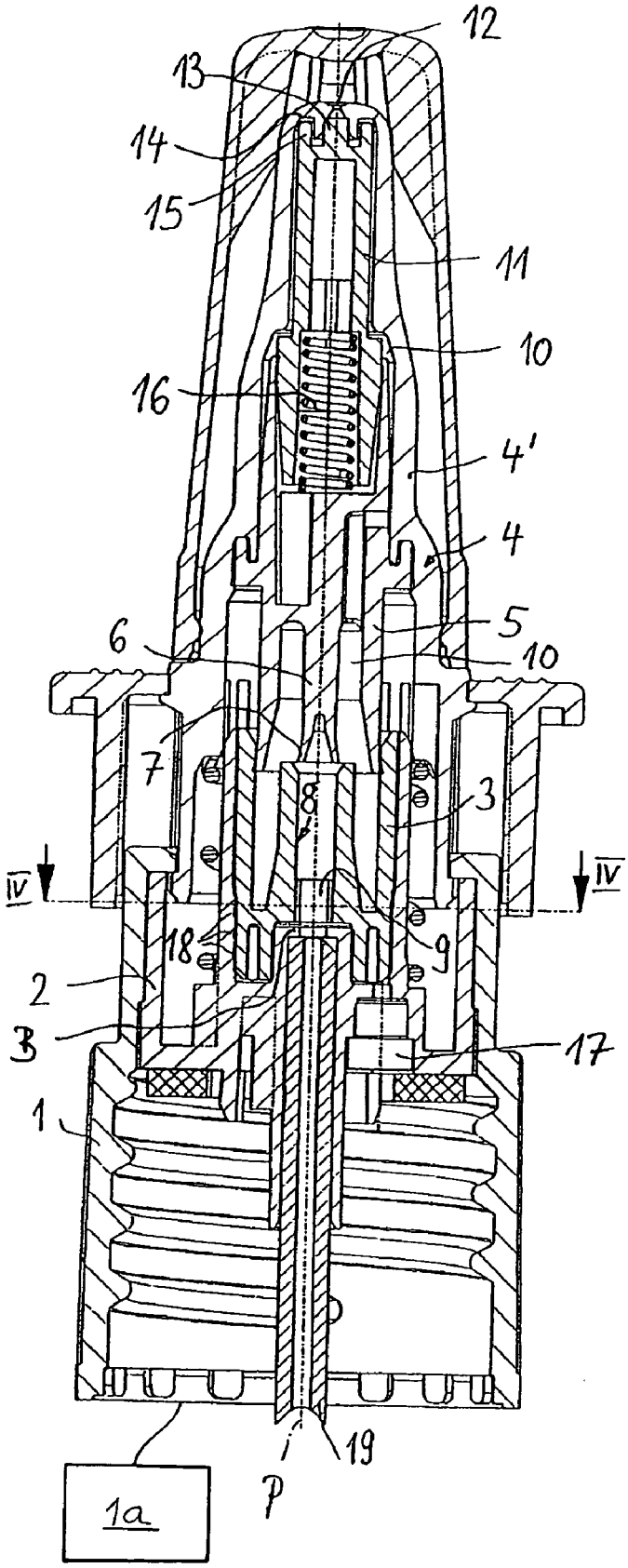
FIG. 1 is a sectional view of a first embodiment of an inventive dosing device.

A dosing device according to FIGS. 1 to 6 is intended for attachment or mounting on a medium reservoir 1*a*, which can receive liquid media such as pharmaceutical or cosmetic media. In the embodiment shown the dosing device is advantageously used for dosing pharmaceutically active liquids, an application of the pharmaceutically active liquid preferably taking place in a nostril of a patient.

The dosing device has an attachment sleeve in the form of a collet 1, which can be screwed on to a container neck of the medium reservoir 1*a*. The attachment sleeve 1 carries a pump casing 2, 3, 4, which is assembled from two components 2 and 3 held in a stationary manner relative to the attachment sleeve 1 and therefore the medium reservoir, and a pump component 4 mounted in linearly movable manner relative to the stationary components 2, 3. Pump component 4 forms an applicator of the dosing device and which in the embodiment shown is in the form of a nasal applicator.

Into the medium reservoir 1*a* projects a rising tube 19, which is inserted in a not shown inlet channel of component 2. In the embodiment shown the inlet channel is hollow and cylindrical. Rising tube 19 is also cylindrical. Component 2 constitutes a support component. Support component 2 has an upwardly open, cup-like receptacle, into which is pressed the stationary pump component 3 and which in this way is rigidly connected to the support component 2. The stationary pump component 3 and movable pump component 4 define a pumping chamber 10, which extends into a top region of the pump component 4 and there issues into a dosing opening 12 which is open to the environment. In the embodiment shown the dosing opening 12 is in the form of a spray nozzle.

Pump component 4 has a multipart construction, in that it is assembled from an outer, hood-like applicator casing 4' and a piston component 5, 6. Between the applicator casing 4' and the piston component 5, 6 is provided an outlet valve 11, which is held in a limited linearly movable and displaceable manner coaxially to a pumping axis P of the dosing device in the applicator casing and the piston component 5, 6. Outlet valve 11 is held in its closed position in FIG. 1 by a spring arrangement 16 in the form of a helical compression spring. With its sleeve-like guide wall, piston component 5, 6 surrounds the outlet valve 11 in a sealing manner towards pumping chamber 10. A not shown, hood-like cover is also placed on applicator casing 4'. To the applicator casing 4' is also externally connected a not shown finger support, which according to FIG. 1 is locked on to the applicator casing 4'. Piston component 5, 6 has a dosing piston 6 oriented coaxially to pumping axis P and which is substantially cylindrical. Dosing piston 6 widens downwards to a sealing lip 7, which forms an inlet valve in the manner of a slide valve. The circumferential sealing lip 7 cooperates during its function as a slide valve with a dosing channel 8, which is provided coaxially to pumping axis P in pump component 3. Dosing channel 8 defines a dosing path for the sealing lip 7. At the outlet side the dosing channel 8 passes into pumping chamber 10. On the inlet side to dosing channel 8 is connected an inlet area 9, which has a widened free cross-section compared with dosing channel 8. In the case of a corresponding longitudinal displacement the slide valve opens at the transition of sealing lip 7 from dosing channel 8 to inlet area 9, because the widened cross-section of inlet area 9 is such that liquid can flow past the sealing lip 7 on the outside into dosing channel 8 and therefore into pumping chamber 10. Further details will be given of the design of inlet area 9 hereinafter.

Figure 2:
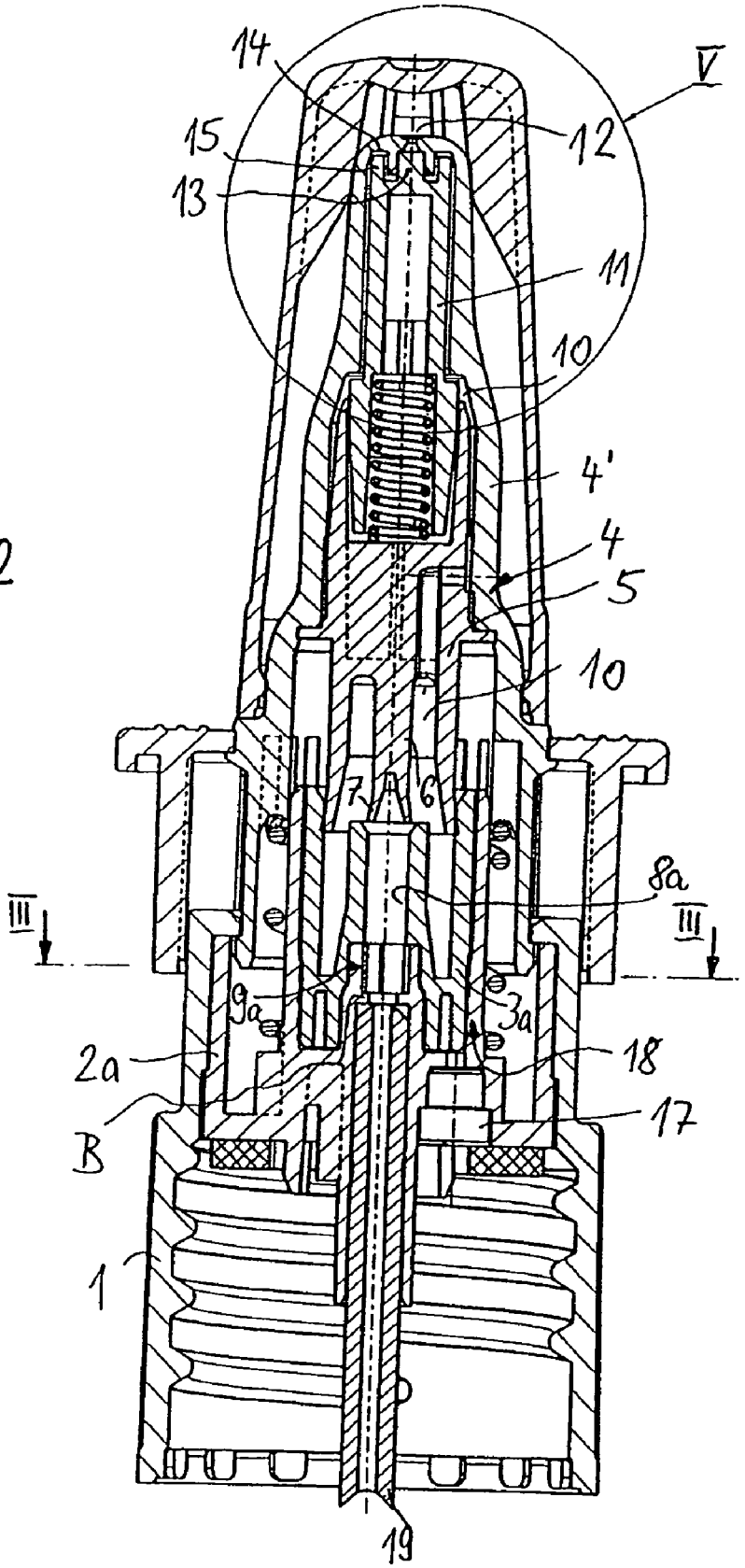
FIG. 2 is a further sectional representation of a further embodiment of an inventive dosing device similar to FIG. 1.

The dosing devices according to FIGS. 1 and 2 are substantially identical to one another, but differ in the construction of inlet area 9, 9*a* respectively and to this extent differing embodiments will be described hereinafter. It is common to both embodiments that the inlet area 9, 9*a* has three longitudinal grooves 20 (FIG. 3) or 21 (FIG. 4), which are made in an annular wall of inlet area 9, 9*a*. In the embodiment according to FIGS. 1 and 2 the longitudinal grooves 21 are relatively narrow. In the embodiment according to FIGS. 2 and 3 they are correspondingly wider. The longitudinal grooves are distributed in uniformly spaced manner over the circumference of the otherwise cylindrical inlet area 9, 9*a* and extend parallel to pumping axis P. At its wall portions located between the longitudinal grooves 20, 21, the diameter of inlet area 9, 9*a* preferably corresponds at least substantially to the diameter of dosing channel 8, 8*a*.

On its front side facing the medium reservoir, to inlet area 9, 9*a* is connected a diaphragm B, whose passage cross-section is smaller than the passage cross-section of dosing channel 8 and inlet area 9. However, the passage cross-section of diaphragm B is larger than the free channel cross-section of rising tube 19, which is connected to the diaphragm B on the side thereof facing the medium reservoir. Diaphragm B additionally serves as an insertion stop for the rising tube In the embodiment of FIG. 1 the inlet area is shaped integrally in the pump component 3. However, diaphragm B is integrally shaped on to support component 2, as can be gathered from FIG. 1. For this purpose support component 2 forms coaxially to pumping axis P a dome-like bulge, which is frictionally inserted, particularly pressed into a corresponding sleeve-like receptacle of pump component 3 and on its front side facing inlet area 9 terminates with the integrally shaped diaphragm B, which is oriented radially to pumping axis P. Thus, by means of a stepped annular shoulder, inlet area 9 of pump component 3 passes into the sleeve-like, cylindrical receptacle into which is pressed said support component with its corresponding, cylindrically designed bulge. Longitudinal grooves 21 are closed at the end towards dosing channel 8, but are open towards its facing front end.

Figure 3:
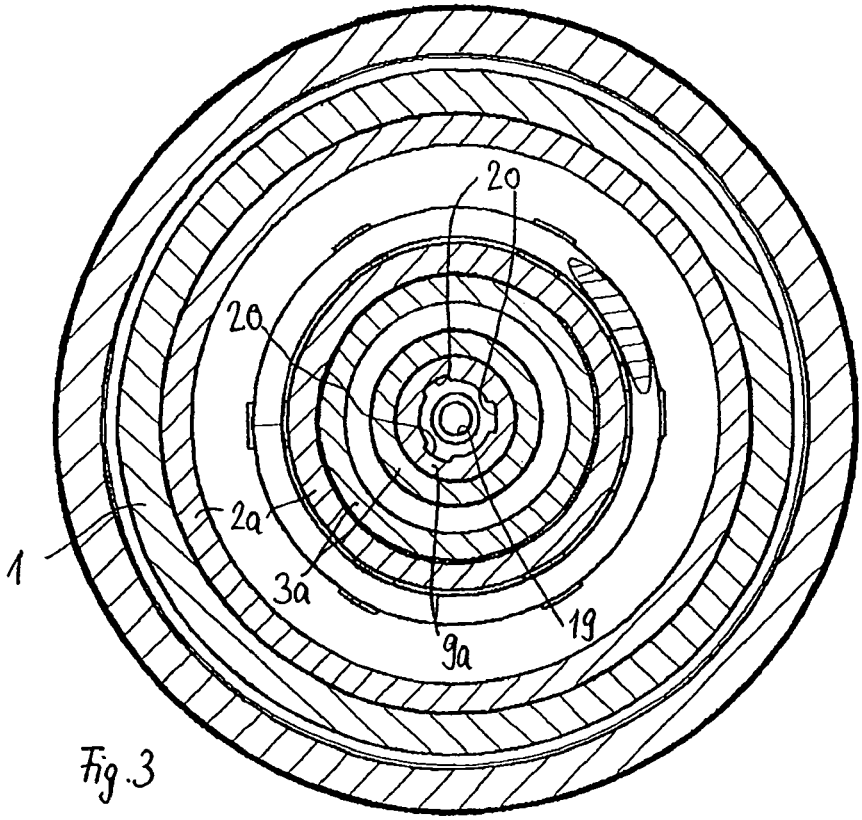
FIG. 3 is a larger scale representation, in cross-section, of the dosing device of FIG. 2 as seen along section line III-III thereof.
Figure 4:
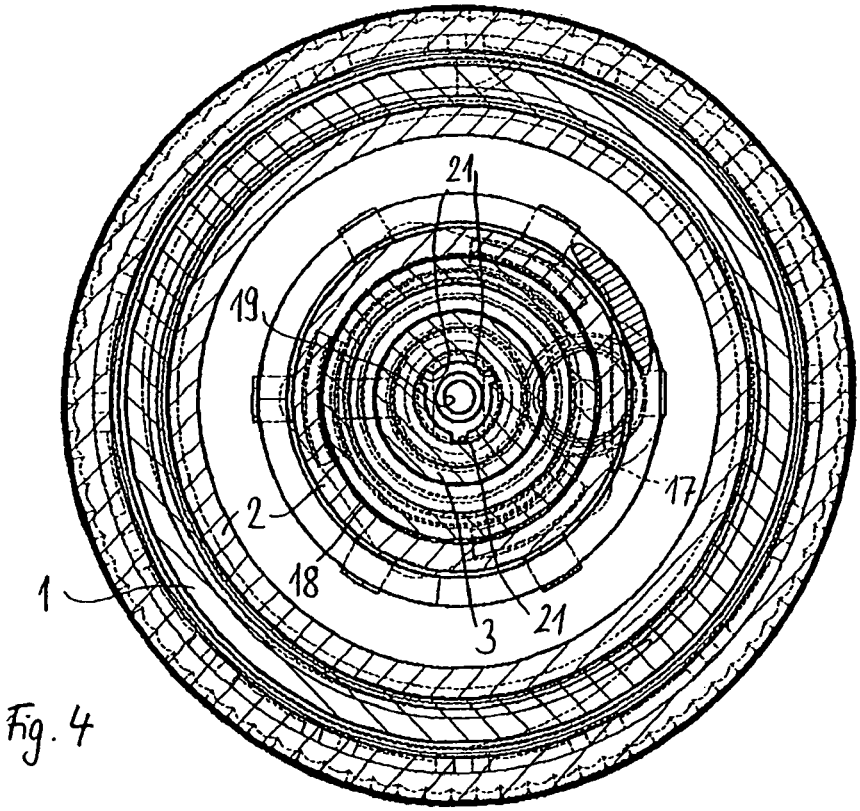
FIG. 4 is a larger scale representation, in cross-section, of the dosing device of FIG. 1 as seen along section line IV-IV thereof.

In the embodiment according to FIGS. 2 and 3 the inlet area 9*a*, including the diaphragm B, is an integral part of support component 2*a*. For this purpose the support component 2*a* is provided with an upwardly projecting, rim-like extension into which is integrated inlet area 9*a*. Diaphragm B is shaped integrally below inlet area 9*a*. Support component 2*a* is inserted, coaxially to pumping axis P, with a rim-like extension into a corresponding cylindrical receptacle of pump component 2*a* and is tightly and frictionally connected to pump component 3*a*. The wide longitudinal grooves 20 of inlet area 9*a* are also frontally closed towards dosing channel 8*a*. They are also closed through the construction of diaphragm B towards the opposite front end thereof.

With both embodiments according to FIGS. 1 and 2 and 2/3, the facing circumferential surfaces of the pump component 3, 3*a* and support component 2, 2*a* are provided with circumferential profilings 18 in the vicinity of their mutually engaging wall surfaces in the telescoped state. The profilings 18 are such that gas-permeable flow guide paths are obtained in the form of capillary tubes between a lower front edge of the outer circumferential surface of pump component 3*a* and an upper front edge of said circumferential surface. Thus, a liquid-tight connection between the components is created in the vicinity of profilings 18. However, simultaneously a gas exchange, particularly an air exchange is made possible between the medium reservoir and environment through the at least one capillary tube formed between components 2*a*/3*a* or 2/3 respectively.

Ambient air access to the medium reservoir is made possible by means of a passage provided in support component 2*a* and in which is inserted a filter component 17 serving as a filter unit. Both embodiments according to FIGS. 1 and 2 are identical with respect to the design of the outlet valve 11 and outlet area of applicator casing 4', so that the following statements made relative to FIGS. 5 and 6 apply to both embodiments.

Figure 5:
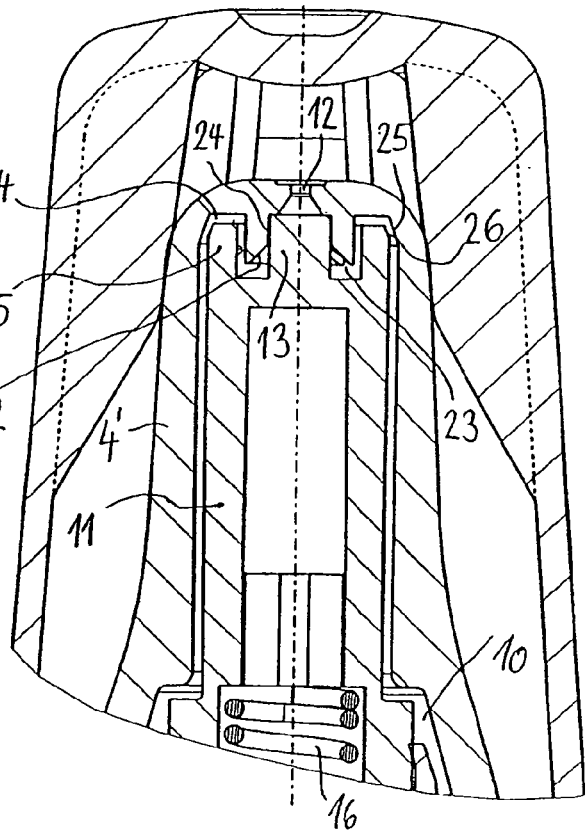
FIG. 5 is a larger scale representation of detail V of the dosing device of FIG. 2.
Figure 6:
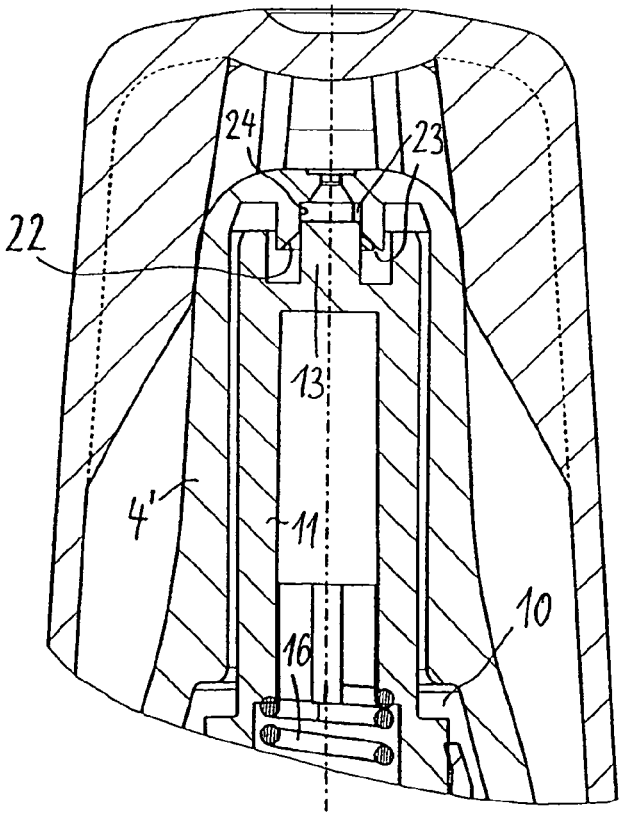
FIG. 6 is a detail according to FIG. 5, wherein an outlet valve of the dosing device is shown in its open position.

As is apparent from FIGS. 5 and 6, on its front side facing dosing opening 12 outlet valve 11 is provided with a cylindrical extension oriented coaxially to pumping axis P and forming a sealing stem 13. Following inwards on to the inwardly conically widened dosing opening 12, an outlet area of applicator casing 4' is provided with a corresponding cylindrical valve seat 24. Sealing stem 13 and valve seat 24 form both an axial and a radial sealing seat in the closed state of outlet valve 11 according to FIG. 5. Around the sealing stem 13 is provided a cylindrical ring-like labyrinth rim 15 which, like the sealing stem 13, is shaped integrally on to outlet valve 11. Labyrinth rim 15 also protects the sealing stem 13 against damage. The annular labyrinth rim 15 has the same cross-section all-round. The cross-section is substantially rectangular, as is apparent from FIG. 5. The labyrinth rim 15 has a reduced height compared with that of sealing stem 13. Between labyrinth rim 15 and sealing stem 13 there is an annular clearance, whose width in the embodiment shown roughly corresponds to the width of labyrinth rim 15 and has a rectangular, internal cross-section.

In a not shown embodiment the labyrinth rim is at least precisely as high as the sealing stem, which brings about a particularly good protection against damage for said stem.

Valve seat 24 is provided in a sleeve-like annular extension of the applicator casing 4', which is coaxial to pumping axis P, projects inwards and serves as a shell portion. The annular extension projecting into the interior of applicator casing 4' is provided on its axially inner front side with a centering cone 22, which defines a wall surface conically tapering towards dosing opening 12. In the conically tapering wall surface are integrated several longitudinal grooves 23 distributed over the circumference of the annular extension of applicator casing 4' and which continue into the valve seat 24 in axially parallel manner to pumping axis P and as is apparent from FIG. 6. Thus, sealing stem 13 forms only an axial sealing seat with valve seat 24, because the flow path to dosing opening 12 is already freed when the sealing stem 13 has moved slightly axially away from the corresponding front face of valve seat 24. The liquid to be discharged can then be transported through the longitudinal grooves 23 upwards past the circumferential surface of sealing stem 13 to dosing opening 12 without the sealing stem 13 having to completely leave its radial guidance within the valve seat 24. As a function of the pressure buildup and maximum lift mobility of outlet valve 11, the latter can also be moved out of valve seat 24 to such an extent that the liquid can flow over the conical faces of centering cone 22 to dosing opening 12, without having to flow exclusively through longitudinal grooves 23.

Around the annular extension comprising valve seat 24 is provided in the interior of applicator casing 4' an annulus 14 into which is introduced the labyrinth rim 15. The inner contour of annulus 14 has wall surfaces running parallel to the wall surfaces of labyrinth rim 15, as is apparent from the cross-section of FIG. 5. FIG. 5 also shows that in the closed state of outlet valve 11, the wall surfaces of annulus 14 are so spaced with respect to the adjacent wall surfaces of labyrinth rim 15 that there is a clearance up to sealing stem 13. The clearance serving as a fluid guide path is already provided between the bottom circumferential surfaces of outlet valve 11 from the inner wall of applicator casing 4' with roughly the same thickness as in the upper labyrinth or outlet area of annulus 14 of applicator casing 4'. On opening outlet valve 11 the liquid flow between annulus 14 and labyrinth rim 15 and the radially inwardly following annular extension is deflected in labyrinth-like manner before it reaches centering cone 22 and consequently longitudinal grooves 23. This makes it possible to obtain a particularly precise and advantageous dosing or spray characteristic.

Figure 7:
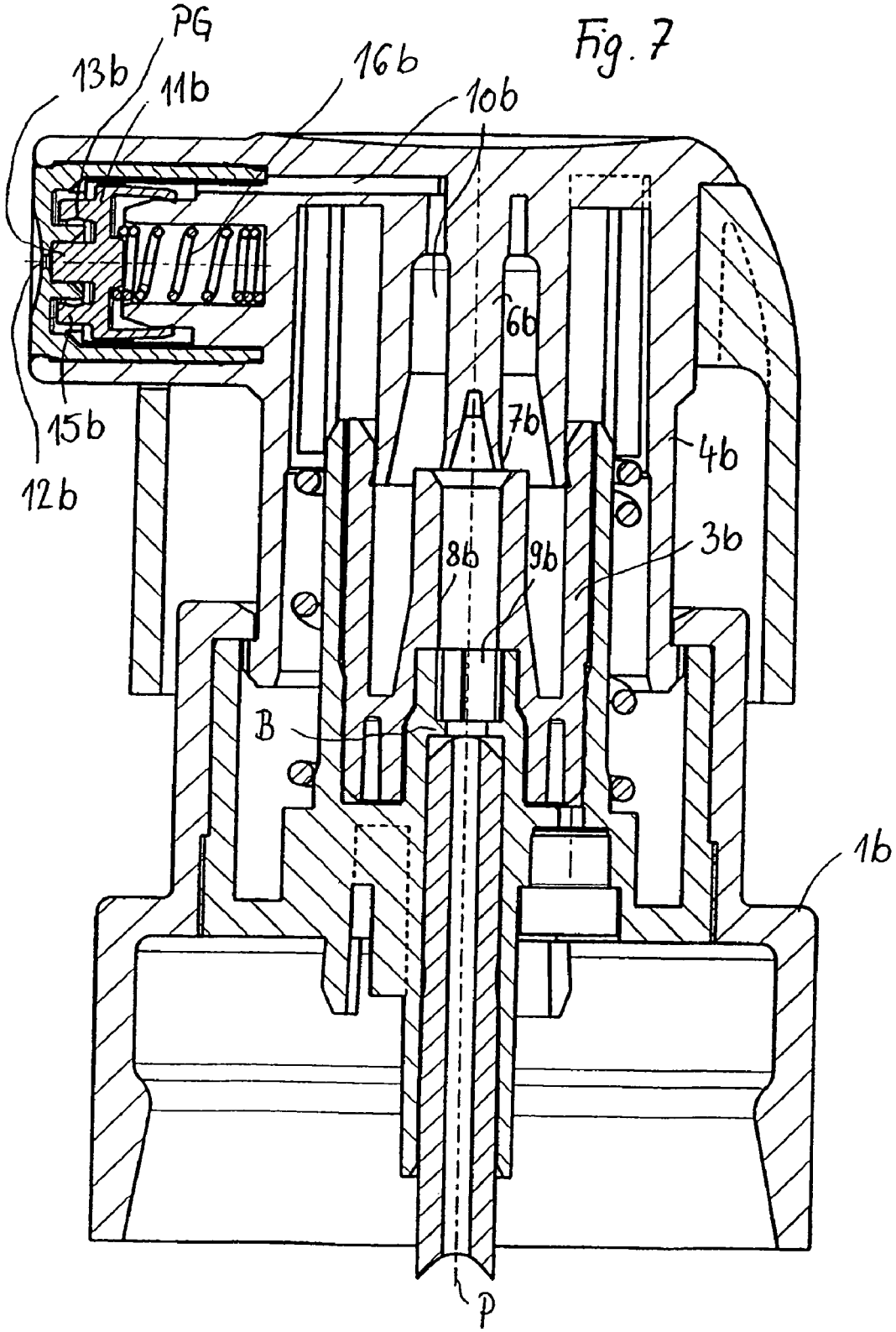
FIG. 7 is a further embodiment of an inventive dosing device in a larger scale sectional representation.

The dosing device of FIG. 7 has a manually actuatable pumping means, which is functionally identical to the pumping means of the previously described embodiments according to FIGS. 1 and 2. Functionally identical components carry the same reference numerals, but a letter b is added. To avoid unnecessary repetition, for the description of the functionally identical components given the same reference numerals, reference is made to the description of the preceding embodiments.

The essential difference of the dosing device according to FIG. 7 is that the applicator casing is constructed in such a way that the outlet valve 11*b* and dosing or discharge opening 12*b* are oriented at right angles to the pumping axis P. Thus, the pumping chamber 10*b* is also provided with flow guide paths deflected at right angles. On the inside of labyrinth rim 15*b* facing the valve seat of the applicator casing, which surrounds in annular manner sealing stem 13*b*, is provided a flat, spherical annular groove PG, which further improves the flow characteristic in the vicinity of the labyrinth rim and consequently a further improved spraying action is achieved.

It is an important idea of the inventive solution, as described relative to the embodiments of FIGS. 1 to 7, that in the vicinity of the inlet valve of pumping chamber 10, namely in the vicinity of slide valve 6, 7 and/or in the vicinity of outlet valve 11, namely in the outlet area directly upstream of the dosing opening 12, there are annular walls in each case provided with flow profilings in order in this way to be able to positively influence the inflow/outflow characteristic of the liquid into or out of the pumping chamber.

The invention claimed is:

1. Dosing device with a manually actuatable pumping arrangement comprising a pumping chamber and an inlet valve constructed as a slide valve, the slide valve having a cylindrical dosing channel comprised of upper and lower parts that are coaxially aligned with a pumping axis, a wall surface of the lower part having circumferentially spaced flow profilings and a piston having a sealing lip configured to slide lengthwise of the dosing channel along the pumping axis while sequentially slidingly engaging a wall surface of the upper part and the wall surface of the lower part of the dosing channel, the dosing channel on an inlet side opening into an inlet area of the lower part remote from the upper part, the inlet area having the flow profilings configured to cause opening of the slide valve upon movement of the sealing lip to the inlet area, the sealing lip being in a closed position of the slide valve while sealingly slidingly engaging the wall surface of the upper part and becoming opened in response to the sealing lip engaging the inlet area of the lower part caused by the flow profilings allowing medium to flow past the sealing lip from a medium reservoir through the flow profilings into the dosing channel and to the pumping chamber, the sealing lip being sealingly movable along the pumping axis over a dosing stroke in the dosing channel so that the slide valve defines a dosing volume for the pumping chamber.

2. Dosing device according to claim 1, wherein the flow profilings are oriented in a longitudinal direction of the dosing stroke.

3. Dosing device according to claim 1, wherein the flow profilings are formed by longitudinal grooves extending parallel to the pumping axis over an axial length of the inlet area, and the flow profilings are arranged in a mutually uniformly distributed manner in a circumferential direction of the inlet area.

4. Dosing device according to claim 1, wherein the inlet area and the dosing channel are provided on separate components.

5. Dosing device according to claim 4, wherein the components are joined together in a coaxially interengaging manner, and on facing circumferential surfaces the components are profiled in such a way that between the circumferential surfaces at least one gas flow capillary tube is formed between axially facing front edges of the circumferential surfaces.

6. Dosing device according to claim 5, wherein the gas flow capillary tube is open at a first end to an environment outside the device and is open at a second end to a medium reservoir, and the second end faces the medium reservoir and is provided with a filter unit.

7. Dosing device according to claim 1, wherein the pumping axis extends longitudinally of said dosing device and the slide valve includes a substantially sleeve-shaped component having an annular inner surface defining the dosing channel, the sealing lip extending circumferentially about the axis and about the piston and contacting the inner surface in the closed position of the slide valve, each flow profiling comprising a groove, each groove having a longitudinal dimension oriented substantially parallel to the pumping axis and having a groove depth extending radially outwardly relative to the axis beyond an inner diameter of the dosing channel.

8. A dosing device comprising:

a manually-actuable pumping arrangement including a pumping chamber, an inlet valve having an open position which permits medium from a medium reservoir to flow into said pumping chamber and a closed position which prevents medium from flowing into said pumping chamber, said inlet valve including a dosing channel comprised of upper and lower parts that are coaxially aligned with a pumping axis, a wall surface of the lower part having circumferentially spaced flow profilings, said dosing channel having an outlet side disposed adjacent to, and in communication with, said pumping chamber and an inlet side spaced from said outlet side, and a piston having a sealing lip configured to slide lengthwise of the dosing channel along the pumping axis while sequentially slidingly engaging a wall surface of the upper part and the wall surface of the lower part of the dosing channel, the dosing channel on said inlet side opening into an inlet area of the lower part remote from the upper part, the inlet area having said flow profilings which are configured to cause opening of the inlet valve upon movement of the sealing lip to the inlet area, said sealing lip, in the closed position of said inlet valve, being movable relative to and within said dosing channel over a dosing stroke to define a dosing volume of medium for discharging into said pumping chamber, said flow profilings being disposed such that movement of said sealing lip within said dosing channel to a position adjacent said inlet area places said inlet valve into the open position by allowing medium to flow from a medium reservoir, through said flow profilings, into said dosing channel and to said pumping chamber.

9. The dosing device according to claim 8, wherein said pumping axis extends longitudinally of said dosing device and said pumping arrangement includes first and second pump components, said piston being formed on said first pump component and said second pump component having a substantially sleeve-shaped wall including an inner surface defining said dosing channel, said sealing lip extending circumferentially about the axis and about said piston and contacting said inner surface of said second pump component in the closed position of said inlet valve.

10. The dosing device according to claim 9, wherein each said flow profiling is a channel having a longitudinal dimension oriented substantially parallel to the pumping axis and a depth extending radially outwardly relative to the pumping axis and beyond an inner diameter of said dosing channel.

11. The dosing device according to claim 9, wherein said flow profilings are channels extending in a direction substantially parallel to the pumping axis and said inlet area, said inlet area and said channels being formed integrally with said second pump component.

12. The dosing device according to claim 9, wherein said pumping arrangement includes a third pump component disposed in supportive engagement with said second pump component and said flow profilings extend in a direction substantially parallel to the pumping axis, said inlet area and said flow profilings being formed integrally with said third pump component.

13. Dosing device with a manually-actuatable pumping arrangement comprising a pumping chamber and an inlet valve, the inlet valve being constructed as a slide valve, the slide valve in a closed position being sealingly movable over a dosing stroke in a dosing channel and defining a dosing volume for the pumping chamber, the dosing channel on an inlet side opening into an inlet area provided with flow profilings, the inlet area and the dosing channel being provided on separate components, wherein the components are joined together in a coaxially interengaging manner and on facing circumferential surfaces the components are profiled in such a way that between the circumferential surfaces at least one gas flow capillary tube is formed between axially facing front edges of the circumferential surfaces, wherein the gas flow capillary tube is open at a first end to an environment outside of the device and is open at a second end into a medium reservoir, the second end facing the medium reservoir and being provided with a filter unit.

* * * * *